United States Patent [19]

Mietz et al.

[11] Patent Number: 4,658,979

[45] Date of Patent: Apr. 21, 1987

[54] PROPELLANT FILLING AND SEALING VALVE

[75] Inventors: Raymond E. Mietz, Barrington; Harlen E. Wilkinson, Crystal Lake, both of Ill.

[73] Assignee: American Can Company, Greenwich, Conn.

[21] Appl. No.: 818,563

[22] Filed: Jan. 13, 1986

[51] Int. Cl.[4] ..... B65D 51/16

[52] U.S. Cl. ..... 220/209; 220/203; 220/367

[58] Field of Search ..... 220/203, 209, 367; 222/482, 394; 137/512, 473

[56] References Cited

U.S. PATENT DOCUMENTS

| | | | |
|---|---|---|---|
| 2,225,395 | 12/1940 | Young | 128/141 |
| 2,301,724 | 11/1942 | Vischer, Jr. . | |
| 2,571,893 | 10/1951 | Kendall | 136/178 |
| 2,769,457 | 11/1956 | Wittenberg | 137/512 |
| 3,082,904 | 3/1968 | Newcomb et al. . | |
| 3,112,846 | 12/1963 | Hein | 222/394 |
| 3,337,091 | 8/1967 | Bartels | 222/95 |
| 3,401,850 | 9/1968 | Anderson | 222/482 |
| 3,405,838 | 10/1968 | Preisendanz . | |
| 3,454,182 | 7/1969 | Morton . | |
| 3,462,046 | 8/1969 | Bartels | 222/394 |
| 3,511,407 | 5/1970 | Palma . | |
| 3,522,900 | 8/1970 | Nicholson | 220/203 |
| 3,693,651 | 9/1972 | Gifford | 137/473 |
| 3,779,276 | 12/1973 | King, Sr. | 137/512.4 |
| 3,981,119 | 9/1975 | Schultz | 53/57 |
| 4,131,722 | 12/1978 | Sugalski | 220/209 |
| 4,143,787 | 3/1979 | Walker | 220/203 |
| 4,177,831 | 12/1979 | Benjamin | 137/513.5 |
| 4,388,997 | 6/1983 | Grime | 220/209 |
| 4,489,767 | 12/1984 | Yamada | 141/82 |

*Primary Examiner*—George T. Hall

*Attorney, Agent, or Firm*—Paul R. Audet; Thomas R. Vigil

[57] ABSTRACT

A non-venting propellant filling and sealing valve is adapted to be seated in a propellant filling hole in a bottom wall of a container and permits pressurization of a container through the hole and thereafter seals the container. The propellant filling and sealing valve includes an umbrella sealing portion, a stem portion and shoulder portions in a collar around the stem portion. The umbrella sealing portion is employed to selectively engage, separate from, and then make a generally annular seal with the interior surface of the bottom wall of the container. The stem portion is used to position the umbrella sealing portion around the filling hole and has axially extending grooves therein for conducting pressurizing fluid to the interior of the container. The shoulder portions in the collar bear against the outer surface of the bottom wall to cause the umbrella sealing portion to engage the interior surface of the bottom wall and the grooves extending axially through the collar and along the stem portion allow fluid access along the stem portion for the pressurizing fluid to enter the container. The method of pressurizing and sealing a pressurized container utilizes the filling and sealing valve described above.

25 Claims, 8 Drawing Figures

PROPELLANT FILLING AND SEALING VALVE

BACKGROUND OF THE INVENTION

The present invention relates to valves and particularly relates to a propellant filling and sealing valve which permits injection of a gas or pressurizing fluid propellant into an aerosol container and thereafter seals the pressurized container.

Pressurized, e.g. aerosol, containers must first be pressurized with a propellant such as pressurizing fluid or gas, for aerosol dispensing of a fluid product. The pressure in the container must be retained until the container is used. Propellant valves have been employed in the pressurizing of aerosol containers since the introduction of aerosol containers as consumer products, and such valves have also served to seal the container so that a useful pressure is retained in the container until the contents thereof have been virtually exhausted. A variety of such propellant filling and sealing valves have been employed.

One such propellant filling and sealing valve is disclosed in the Nicholson U.S. Pat. No. 3,522,900 issued Aug. 4, 1970. The Nicholson valve is seated in a first portion in a hole in a bottom wall of a container and, while the valve is in this position the container is pressurized. The valve is then moved to a second position which seals the container. In use, a first end of the Nicholson valve is inserted through a hole in the container into the interior of the container and propellant pressurizing fluid, e.g., a gas, is pumped into the container through grooves in the first end. The container is sealed by further inserting the Nicholson valve into the container. When further inserted, the grooves no longer communicate with the exterior of the container and a shoulder of the valve engages the inside of the container about the opening therein and a base is brought into contact with the outer surface of the wall around the hole to form a seal thereagainst.

The Nicholson valve is currently used with a container which houses an interior corregated plastic bottle.

Other sealing valves have undoubtedly been attempted. One such valve is disclosed in an August 1961 article in "Modern Packaging" entitled "*The Free-Piston Aerosol*". In that article, it was brought out that American Can Co. developed a special gassing and plugging unit for propellant filling and sealing of a free-piston type aerosol container. The unit contemplated inserting a cylindrical plug into a filling hole. The plug was cut from a continuous length of plug material fed through a special chuck orifice while the container remained pressurized to seal the aerosol.

Manufacturers of container valves, such as Vernay Laboratories, Inc. of Yellow Springs, Ohio, have produced a variety of valves for various purposes. One such non-analogus valve known as an umbrella check valve is employed in the non-analogus art of pressure relief mechanisms. In such environment, the umbrella check valve is used as a pressure relief valve for containers of volatile substances. The umbrella valve has a cross-section which is generally shaped like a letter "T", i.e. it has, an umbrella top, forming a "bar" of the "T" with a curved upper surface and a bulbous stem. The stem is partially inserted downward through a vent hole in a container top wall so that the bulbous portion of the stem is on the interior side of the container top wall and a flat portion of an undersurface of the "bar" of the "T" of the umbrella top of the valve seals against the outer surface of the top wall of the container. An interference fit is established between the container top wall containing the vent hole and an ungrooved circumference of the stem between the umbrella top and bulbous portion of the stem. When the container becomes pressurized to a predetermined pressure, such as by the ambient temperature heating of a liquid and a gas phase of the liquid in the container, the umbrella top is forced upward away from the upper outer surface of the container top wall by pressurized fluid channeled through a groove in the bulbous stem to vent the pressurized fluid until the over pressure condition is relieved.

The Nicholson valve and the American Can Co. plug require the use of somewhat complex machines which both insert the sealing valves in containers and pressurize the containers.

It has been found that the Nicholson valve may be readily forced to one side with a pencil to degas the container. Also, with a two step insertion procedure, sometimes the valve is inserted all the way, i.e. the two steps of the insertion are done in one step, before gas can be injected into the container. This results in wastage, since the container cannot then be filled with gas. Further, the American Can Co. plug may be removed with pliers.

The Vernay umbrella valve is used for pressure relief venting and not for facilitating pressurizing a container with a propellant and subsequently sealing the container.

Tests were made with an umbrella valve used in the non-analogus art of shock absorbers to see if it could be employed as a propellant filling and sealing valve and a number of drawbacks were discovered. During a high pressure filling operation with pressurized gas acting on the underside of the umbrella top, the bulbous portion of a stem of the valve exhibited a tendency to pass through the container bottom wall resulting in the valve being "blown" into the container. Also, the tight interference between the umbrella top, the wall of the container and the bulbous portion of the stem was such as to require relatively high filling pressures for product filling, which makes it difficult to vent trapped air when product filling.

Also, when high filling pressures are used to pressurize a free-piston aerosol container using such umbrella valve with a single gas filling channel along the stem thereof, the geometry of the umbrella top, with a right angle junction of stem and top, results in the flow of turbulent pressurizing fluid into the container in a manner that could cock the piston and contaminate a product with pressurizing fluid.

The Nicholson valve requires a first step insertion, propellant filling, and a second step insertion. The American Can Co. plug requires cutting the plug material to form the plug, filling, and then plugging with the cut length of plug material under pressure.

As will be described in greater detail hereinafter, the propellant filling and sealing valve of the present invention differs from the previously proposed propellant filling and sealing valves by providing an umbrella shaped valve which, for a three-piece container, preferably, is placed onto the inner surface of a bottom wall for the container, before the bottom wall is joined to a container body to form a container, with a stem portion of the valve being inserted through a propellant filling hole in the bottom wall and with an underside of an umbrella sealing portion thereof being positioned adjacent a surface of the bottom wall which becomes an inner upper surface of the bottom wall when the container is assembled. For a two-piece container having an integral bottom, before pressurization, the valve is seated in a hole which can be in the integral bottom.

SUMMARY OF THE INVENTION

According to the invention, there is provided a propellant filling and sealing valve which permits the injection of propellant pressurizing fluid or gas under pressure through a propellant filling hole in a wall of or for a container and for thereafter sealing the container, said propellant filling and sealing valve comprising:

umbrella sealing means adapted to selectively make, engage, separate from, and then make a non-venting seal with the interior surface of the wall about the propellant filling hole therein;

stem means operatively connected to said umbrella sealing means and adapted to be received in the filling hole for positioning said umbrella sealing means around the filling hole thereby to enable said umbrella sealing means to engage, separate from, and then make the seal with the interior surface of the wall, and having means for channeling pressurizing fluid along said stem means to said umbrella sealing means and into the container during the pressurization of the container; and shoulder means operatively joined to said stem means and having a surface adapted to abut the portion of the wall exterior of the container about the filling hole to prevent the valve from moving into the container during pressurization, said shoulder means having passage means therein communicating with, and cooperating with, said channeling means in said stem means and said channeling means serving, with said so-adapted umbrella sealing means, to allow pressurizing fluid to enter the container.

Further according to the invention there is provided a method of injecting a propellant into a container and thereafter sealing the container, the container having a propellant filling hole in a wall for the container, said method comprising the steps of:

positioning a valve in the filling hole, said valve including cooperative umbrella sealing means, stem means and shoulder means, the umbrella sealing means being located adjacent an interior surface of the wall for the container, the stem means having a portion protruding through the filling hole of the container and the shoulder means abutting a portion of the outer surface of the wall which outer surface will be outside of the container when the wall is joined to a container body to form the container;

providing passage means along the stem means and through the shoulder means;

pressurizing the container with a propellant by creating and maintaining a high pressure region of propellant adjacent the outer surface of the wall surrounding the portion of the stem means protruding out of the wall, utilizing the pressurized propellant flowing through the passage means for temporarily deforming the umbrella sealing means inwardly, thereby lifting the umbrella sealing means from its engagement with the inner surface of the wall, to allow the pressurized fluid to enter the container until a preselected gas volume and pressure greater than atmospheric are reached; and sealing the container by exposing the outer surface of the wall of the container to atmospheric pressure whereby the pressure greater than atmospheric pressure in the container forces the umbrella sealing means against the interior surface of the wall of the container to establish a non-venting seal against the interior surface of the wall.

DESCRIPTION OF THE PREFERRED EMBODIMENT

Figure 1:
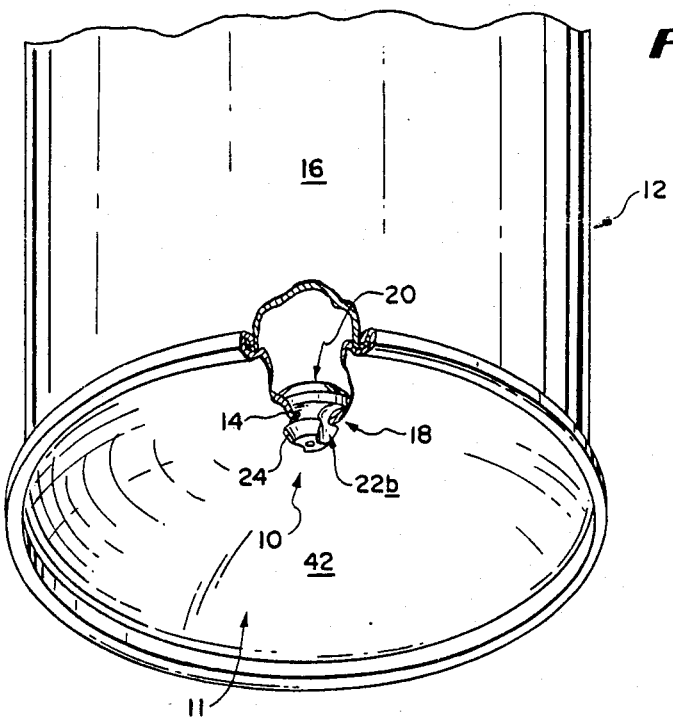
FIG. 1 is a perspective view of the bottom wall of a pressurized container with portions broken away and shows the filling and sealing valve of the present invention mounted in a filling hole in the bottom wall of the container.

Referring now to FIG. 1 in greater detail, there is illustrated therein a propellant filling and sealing valve 10, constructed according to the teachings of the present invention, mounted in a domed bottom wall 11 of an aerosol container 12 (partially shown), the dome extending into the container 12 so the bottom wall 11 can withstand the pressure inside the can without deforming. The valve 10 is inserted into a propellant filling hole 14 in the bottom wall 11 of the container 12, before the bottom wall 11 is joined to a container body 16 to form the container 12, by insertion machinery which is not shown and which is not part of the present invention. However, the valve 10 can be mounted to the bottom wall 11 after the bottom wall 11 has been seamed or joined to the container body 16 such as where the body has an integral bottom wall and a two-piece container assembly.

Figure 2:
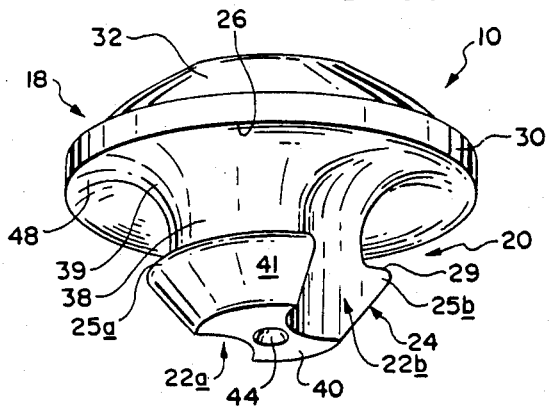
FIG. 2 is an enlarged perspective view of the valve shown in FIG. 1 viewing same from a position below the valve.
Figure 3:
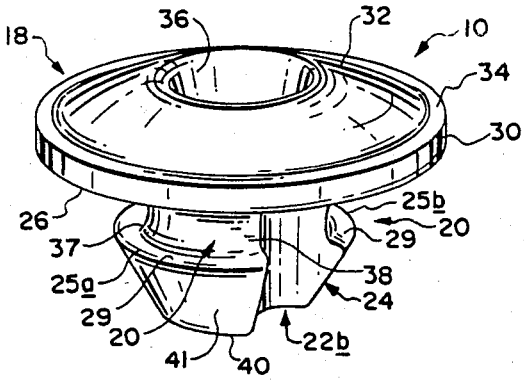
FIG. 3 is a perspective view of the valve shown in FIG. 2 viewing same from a position above the valve.

FIGS. 2 and 3 show the principal features of the filling and sealing valve 10 in greater detail. In general, the valve 10 includes a top umbrella sealing portion 18 defining a top end of the valve 10, and a stem portion 20. The stem portion 20 has at least one, but, as shown, preferably has two diametrically opposed axially extending filling grooves **22*a* and 22*b* therein and a collar 24 through which the grooves 22*a* and 22*b* also extend. The grooves 22*a* and 22*b* serve to divide the collar 22 into two separate generally annular shoulder portions 25*a* and 25*b*, which include an upper collar surface 29 (FIG. 3**).

The grooves 22*a* and 22*b* extend in a curved manner into an arcuate concave bottom surface 26 of the umbrella sealing portion 18 so as to form and define filling furrows 27*a* and 27*b* (see FIG. 5) in the bottom surface 26.

As shown, the valve 10 is most preferably formed as an integral structure from elastomeric material, preferably a nitrile based elastomer, or the like, having a Durometer value between 60 and 90, and preferably about 80.

Figure 7:
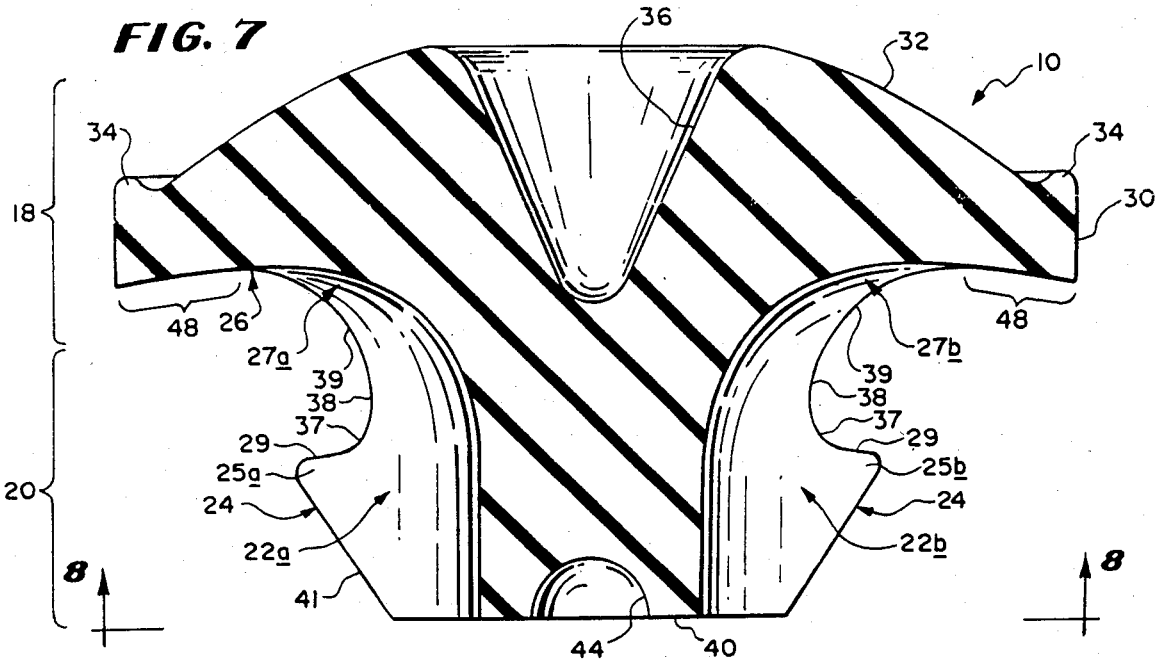
FIG. 7 is an enlarged vertical sectional view of the filling and sealing valve similar to the view shown in FIG. 4.
Figure 8:
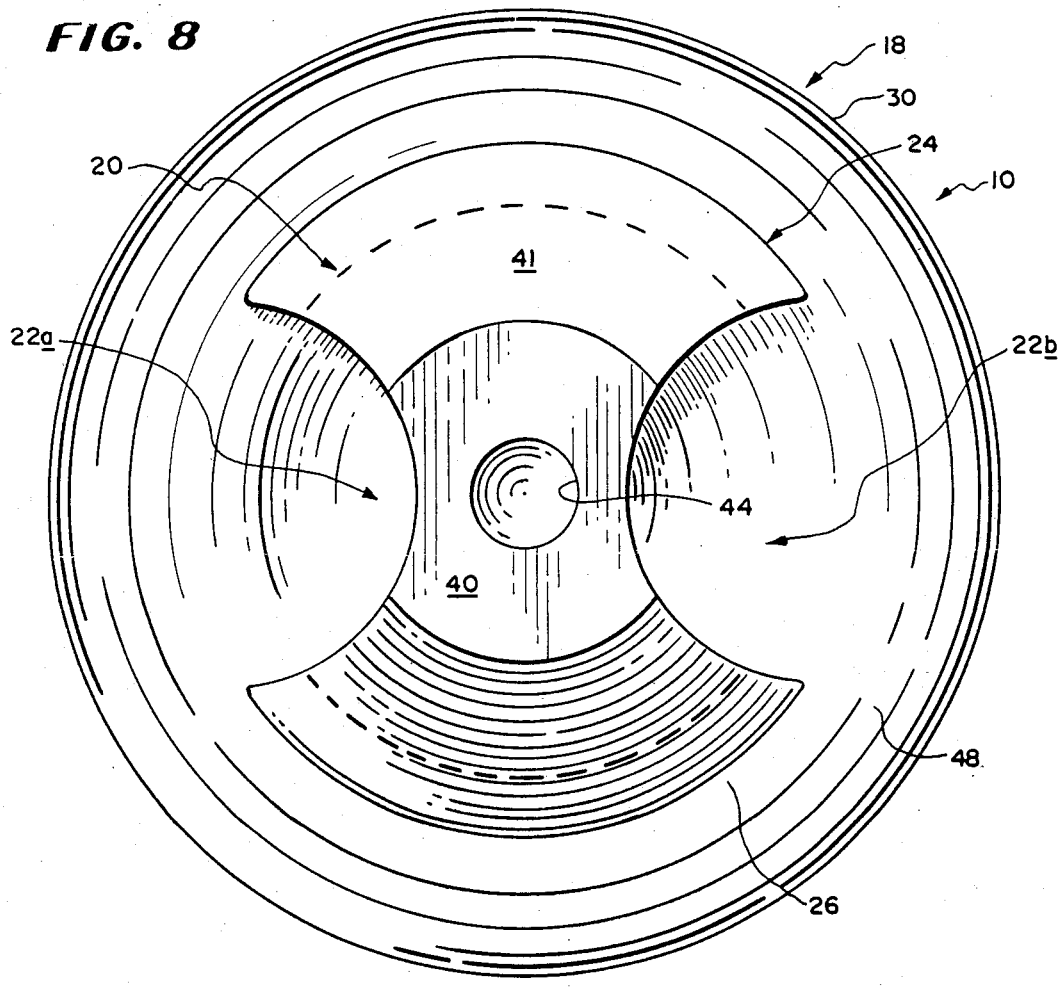
FIG. 8 is a bottom plan view of the filling and sealing valve and is taken along line 8—8 of FIG. 7.

As shown in FIG. 7, the arcuate concave bottom surface 26 of the umbrella sealing portion 18 extends radially outwardly to a generally cylindrical peripheral surface 30. In general, the bottom surface 26 is a continuous, smooth, arcuate concave surface to avoid wrinkling under stress, particularly adjacent the stem portion 20 and adjacent the peripheral surface 30. The umbrella sealing portion 18 further includes an upper surface 32 which is also generally continuous, smooth and convex. An annular upwardly extending ridge 34 is provided at the outer edge of the surface 32 adjacent the generally cylindrical peripheral surface 30 to facilitate molding of the valve 10.

As illustrated in FIG. 7, the minimum vertical cross-sectional thickness of the umbrella sealing portion 18 is somewhat inward of the ridge 34. As a result, the ridge 34 is radially relatively stiff. However, the arcuate concave bottom surface 26 adjacent to generally cylindrical peripheral surface 30 is movable or deformable vertically under a pressure differential.

The upper surface 32 with the ridge 34 has the shape, in cross-section, of a recurved bow, i.e. a bow with the outer ends (at ridge 34) curved forwardly in the direction of the arch of the bow. The bottom surface 26 has the shape of an umbrella.

The upper surface 32 has a locating well 36 formed therein. The locating well 36, in a manner well known in the art and cooperatively with an insertion tool or mechanism, facilitates positioning of the valve 10 during its insertion into filling hole 14 by riding on a locating pin of the insertion machinery.

It is desirable to limit the depth of the locating well 36, for most geometries in the preferred elastomers, to avoid bulging the stem portion 20 beyond the container bottom wall 16. The generally frusto conical shape of the locating well 36, with smooth transitions to the remaining portion of the upper surface 32, provides for sufficient rigidity for insertion and adequate flexibility in operation, with ease of manufacture.

From and above the collar 24, the stem portion 20, has an arcuate surface 37 which merges with and extends from the flat surface 29 to a generally cylindrical surface 38 of the stem portion 20. The surface 38 of the stem portion 20 is cylindrical except for the filling grooves 22*a* and 22*b* extending in and along the surface 38 of the stem portion 20. The generally cylindrical surface 38 merges with an arcuate surface 39 that extends upwardly from it and extends outwardly to, and merges with, the arcuate concave bottom surface 26 of the umbrella sealing portion 18.

The diameter of the generally cylindrical surface 38 need only be large enough to provide a snug fit with the filling hole 14 when the surface 38 of the stem portion 20 is received therein and to prevent undue extension or failure under tension; and need only be small enough to pass through filling hole 14, although some slight degree of interference is desirable to provide the snug fit.

The total area of filling grooves 22*a* and 22*b* should be such as to avoid undue distortion of any portion of the valve 10 during pressurization which could cause it to blow into the container 12 or which could cause product contamination.

The collar 24 is integral with the stem portion 20 and extends from the end of the stem portion 20 furthest from the umbrella sealing portion 18, i.e. from a bottom surface 40 of the stem portion 20 upward to and including the surface 29. The surface 29 which forms shoulder portions 25*a* and 25*b* in the illustrated embodiment of the valve 10 is a flat surface 29. Although the surface 29 is preferably flat, it could be concave and frusto-conical, if desired.

In general outline, collar 24 is a frusto cone with an inclined surface 41 between the upper surface 29 and the generally flat exterior bottom surface 40 of stem portion 20. However shaped, collar 24 should include an abutting surface, e.g. surface 29, adapted to form the partially annular shoulders 25*a* and 25*b* for engaging against and abutting a portion of an outer surface 42 of the bottom wall 11 about the filling hole 14, and shown in the illustrated embodiment abutting against a downwardly turned rim 43 which partially defines the filling hole 14. The shoulders 25*a* and 25*b* should be upwardly flexible to facilitate downward insertion of the valve 10 through the filling hole 14 in the bottom wall 11, and stiff against a force exerted in a downward direction to prevent the valve 10 from being blown upwardly into the container 12 during pressurization, or being moved upwardly into the container 12 for other reasons.

The surface 29 extends to the largest diameter of the frusto cone shape of the collar 24 to form in cooperation with the composition of the material from which the valve 10 is made, strong shoulders 25*a* and 25*b*. The radial extent of surface 29 of the shoulders 25*a* and 25*b* can approach, be equal to, or be greater than the thickness of the bottom wall 11 at the rim 43 as shown in FIGS. 4 and 5 so long as the composition of the material and the radial extent of the surface 29, i.e. shoulders 25*a* and 25*b*, are such as to impart sufficient strength to the collar 24 so that the collar 24 can withstand the filling pressure encountered without the valve 10 being blown into the container 12.

The filling grooves 22*a* and 22*b* are symmetrically disposed in the periphery of the collar 24 and extend to, and can be viewed as a continuation of the filling furrows 27*a* and 27*b*.

It is desirable that the generally flat bottom exterior surface 40 include an ejection dimple 44 for assisting in releasing the valve 10 from the mold in which it is formed.

Figure 4:
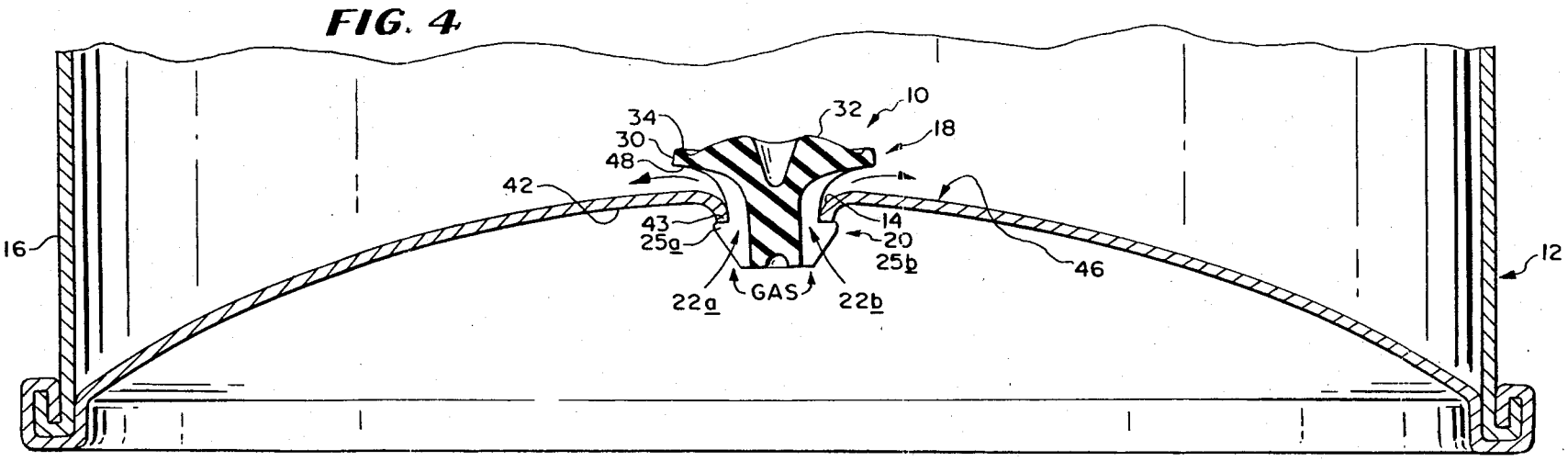
FIG. 4 is an enlarged partial cross-section of the bottom of the container shown in FIG. 1 and shows the operation of the filling and sealing valve during pressurization of the container.
Figure 5:
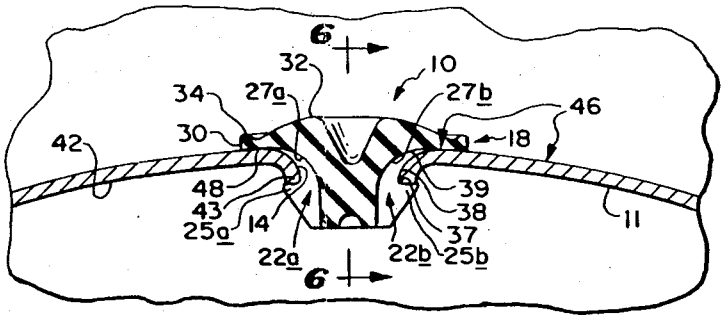
FIG. 5 is a cross-sectional view of the bottom of the container similar to the view shown in FIG. 4 and shows the valve sealing the container when pressurization is complete and the container is exposed to ambient pressure.

Pressurization of the container 12 with the propellant filling and sealing valve 10 mounted in the bottom wall 11 is illustrated in FIG. 4. The pressurizing machinery, not being part of this invention, is not shown, but includes pressurizing sealing means to surround propellant filling hole 14 and a pressurizing vent surrounded by the pressurizing sealing means to conduct propellant pressurizing fluid or gas to the propellant filling and sealing valve 10. As the pressurizing fluid, or gas, acts on the propellant filling and sealing valve 10, the pressurized fluid is conducted through grooves 22*a* and 22*b* and filling furrows 27*a* and 27*b* to the arcuate concave bottom surface 26 of the umbrella sealing portion 18. A filling pressure differential then exists between the bottom surface 26 and the upper surface 32 of the umbrella sealing portion 18 with the upper surface pressure being less. As a result of the filling pressure differential, the umbrella sealing portion 18 is temporarily deformed upwards to unmake the low force engagement, between the surface 26 of the valve 10 (FIG. 7) and an upper surface 46 of the bottom wall 11 thereby to permit pressurizing fluid to be channeled or delivered to the interior of the container 12 in the manner shown.

When the container is of the free-piston variety, it is most desirable that the pressurized fluid flow be symmetrically directed to the piston to avoid cocking it and contaminating the product to be dispensed. As the container is pressurized, the filling pressure differential tends towards zero and the filling and sealing valve 10 tends to pass from its undistorted shape shown in FIG. 2, through its temporarily deformed shape shown in FIG. 4 to its non-venting high force (pressure) sealing position shown in FIG. 5.

In FIG. 5, the container 12 is pressurized to its desired interior pressure and is subject to normal atmospheric pressure on the outer surface 42 of the bottom wall 11. The valve 10 at that stage, has passed through its undistorted shape, and is in a high force seal maintaining position with the container 12 in its pressurized condition. The reversal of the direction of the pressure differential from that shown in FIG. 4 to that shown in FIG. 5 is such that, in FIG. 5, the arcuate concave bottom surface 26 is subject to a lower pressure. This causes the umbrella sealing portion 18 to form a smooth annular seal about the filling hole 14 on interior surface 46 of the bottom wall 16 adjacent the filling hole 14. In this respect, an annular sealing surface 48 of the bottom surface 26 abuts and is in face to face sealing engagement with at least a portion of upper surface 46 of the bottom wall 11 about the filling hole 14 to form the annular seal.

Figure 6:
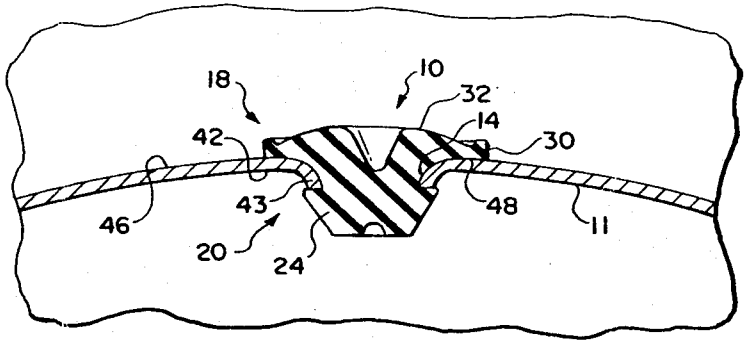
FIG. 6 is a fragmentary, enlarged, cross-sectional view of the valve and container bottom wall shown in FIG. 1 as would be taken along a vertical section 90° to the vertical section shown in FIG. 5 and shows the conforming of the valve to the inner surface of the container at the filling hole.

Preferably, the enveloping radius of curvature of the arcuate concave bottom surface 26 and of the arcuate surface 39 are selected to generally match the enveloping radius of the interior surface 46 about the filling hole 14 in the bottom wall 11 as shown in FIG. 6. Additionally, except for the filling grooves 22*a* and 22*b* there is a snug fit between the generally cylindrical surface 38 of the stem portion 20 and the adjacent generally cylindrical portion of the filling hole 14. Also, the surface 29, i.e., shoulders 25*a* and 25*b*, bear against the rim 43 so that the valve 10 grasps or grips the bottom wall 11 between the bottom surface 26 of the umbrella sealing portion 18 and the shoulder forming surface 29 of the collar 24. The bearing engagement also serves to establish the low force engagement between the annular sealing surface 48 and the interior surface 46 of the bottom wall 11 prior to pressurization of the container 12.

Annular sealing between annular surface 48 and surface 46 provides a conformal, positive strong seal.

Although primary sealing is established between annular sealing surface 48 and the bottom wall interior surface 46, secondary, but incomplete, sealing is effected between valve surfaces 39, 38 and 37 (except in the areas of the furrows 27*a* and 27*b* and filling grooves 25*a* and 25*b* respectively therein) and the interior surface 46 about the filling hole 14.

The structure of the valve 10 of the present invention naturally lends itself to a single one step method of seating the valve 10 in the bottom wall 11, filling a container 12 having the bottom wall 11 with a pressurizing fluid and sealing the pressure within the container 12 in a non-venting manner.

The method includes utilizing a propellant filling and sealing valve 10 having an umbrella sealing portion 18, a stem portion 20 with at least one and preferably two annular grooves 22*a* and 22*b* therein and a collar 24 through which the grooves 22*a* and 22*b* extend and having the annular shoulders 25*a* and 25*b* with an upper surface 29, and positioning the propellant filling and sealing valve 10 in the hole 14 in the bottom wall 11 so that the umbrella sealing portion 18 will be on the inside of the container, with the stem portion 20 protruding through the filling hole 14 in the bottom wall 11 and the collar 24 will be located on the outside of the container 12 with the shoulders 25*a* and 25*b* abutting and bearing against a portion of the outer surface 42 of the bottom wall 11 about the hole 14. Following positioning, pressurizing the container 12 through the grooves 22*a* and 22*b* and furrows 27*a* and 27*b* is achieved by creating and maintaining a high pressure region surrounding the exterior of the collar 24 of the valve 10 sufficient to upwardly distort or deform the annular sealing surface 48 away from its low force engagement with the interior surface 46 and to allow fluid to enter the container 12 until the container 12 reaches a desired preselected pressure greater than atmospheric pressure. Sealing is performed by merely exposing the pressurized container 12 to atmospheric pressure and utilizing the greater than atmospheric pressure in the container 12 at that point in time and thereafter, as a pressure force against the upper surface 32 of the umbrella sealing portion 18 of the valve 10 to force the underside 26, i.e. annular sealing surface 48 thereof, against the surface 46 for effecting a strong non-venting annular seal about the hole 14.

The valve 10 described in the above process achieves the ends desired. In this respect, the propellant filling and sealing valve 10 is employed to fill and seal the pressurized container 12 once it is inserted to its described position. The umbrella sealing portion 18 is employed to selectively engage, separate from, and then make a generally annular seal with the interior surface 46 of the bottom wall 11 of the container 12 in response to the pressure differential between the container 12 interior and the exterior of the container 12 surrounding its filling hole 14. The stem portion 20 is employed to position the umbrella sealing portion 18 within the container 12 to engage, separate from, and then make the annular seal against interior surface 46 to allow the pressurizing fluid to be channeled beneath the bottom surface 26 of the umbrella sealing portion 18 during a filling operation and then to make the seal. The collar 24 with the shoulders 25*a* and 25*b* in combination with the umbrella sealing portion 18 serves to position and hold the stem portion 20 in the hole 14, and yet provides fluid access to the container 12 through the grooves 22*a* and 22*b* and filling furrows 27*a* and 27*b* for pressurizing fluid into the container 12.

From the foregoing description, it will be apparent that the propellant filling and sealing valve 10 and method of using same of the present invention have a number of advantages over what has been done before, some of which advantages have been described above and others of which are inherent in the invention.

Also, it will be apparent that various modifications can be made to the propellant filling and sealing valve of the present invention without departing from the teachings of the invention. Accordingly, the scope of the invention is only to be limited as necessitated by the accompanying claims.

We claim:

1. A propellant filling and sealing valve which permits the injection of propellant pressurizing fluid or gas under pressure through a propellant filling hole in a wall of or for a container and for thereafter sealing the container, said propellant filling and sealing valve comprising:

umbrella sealing means adapted to selectively make, engage, separate from, and then make a non-venting seal with the interior surface of the wall about the propellant filling hole therein;

stem means operatively connected to said umbrella sealing means and adapted to be received in the filling hole for positioning said umbrella sealing means around the filling hole thereby to enable said umbrella sealing means to engage, separate from, and then make the seal with the interior surface of the wall, and having means for channeling pressurizing fluid along said stem means to said umbrella sealing means and into the container during the pressurization of the container; and shoulder means operatively joined to said stem means and having a surface adapted to abut the portion of the wall exterior of the container about the filling hole to prevent the valve from moving into the container during pressurization, said shoulder means having passage means therein communicating with, and cooperating with, said channeling means in said stem means and said channeling means serving, with said so-adapted umbrella sealing means, to allow pressurizing fluid to enter the container.

2. The valve of claim 1 wherein said umbrella sealing means has a varying cross-sectional thickness and a minimum thickness occurs adjacent to, but radially inwardly of, the outer periphery of said umbrella sealing means and said umbrella sealing means has an arcuate concave bottom surface immediately adjacaent to the minimum thickness which is adapted to provide a sealing surface for sealing against the interior surface of the wall.

3. The valve of claim 2 wherein the outer periphery of said umbrella sealing means has a cross-sectional thickness exceeding the minimum thickness.

4. The valve of claim 3 wherein said umbrella sealing means includes an upper surface having a locating well therein.

5. The valve of claim 2 wherein said upper surface of said umbrella sealing means defines a profile similar to a recurved bow, said bottom surface is similar to that of an umbrella and said umbrella sealing means has a generally cylindrical peripheral surface extending between said upper and bottom surfaces, at their respective peripheries.

6. The valve of claim 5 wherein said upper surface of said umbrella sealing means in the marginal area adjacent said generally cylindrical peripheral surface of said umbrella sealing means has an upwardly and annularly extending ridge which facilitates molding of said valve.

7. The valve of claim 1 being made of an elastomeric material having a Durometer value between 60 and 90.

8. The valve of claim 1 wherein said umbrella sealing means has an arcuate concave bottom surface, said stem means has a bottom surface and includes a portion which is generally cylindrical in shape except for said channeling means extending therethrough and said channeling means comprises two axially extending, diametrically opposed filling grooves in said stem means, each filling groove extending from said stem means bottom surface to said arcuate concave bottom surface of said umbrella sealing means.

9. The valve of claim 8 wherein said shoulder means are defined by a collar integral with and extending around said stem means, and said passage means comprises extensions of said filling grooves of said channeling means in and through said collar so as to define said shoulder means with two shoulder portions.

10. The valve of claim 9 wherein said arcuate concave bottom surface of said umbrella sealing means has two diametrically opposed filling furrows therein which communicate with, cooperate with, and form smooth continuations of, said filling grooves for allowing and assisting pressurized fluid to flow from said filling grooves defining said channeling means in said stem means along said arcuate concave bottom surface of said umbrella sealing means into the container.

11. The valve of claim 9 wherein said collar has the shape of a generally frusto cone extending upwardly from said stem means bottom surface.

12. The valve of claim 1 wherein said channeling means and said passage means comprise at least one generally axially extending groove in said stem means.

13. The valve of claim 1 wherein said umbrella sealing means has a bottom surface which includes an annular sealing surface adjacent the periphery of said umbrella sealing means, said annular sealing surface being adapted to engage, separate from and then make the non-venting seal with the interior surface of the wall.

14. The valve of claim 13 wherein the distance between said bottom surface of said umbrella sealing means and said shoulder means, relative to the transverse extent of the bottom wall in the area of the filling hole is such that said shoulder means bear against the outer surface of the bottom wall so as to cause and create a low force engagement of said annular sealing surface with the interior surface of the wall prior to pressurization of the container.

15. The valve of claim 1 wherein said stem means has a bottom surface having an ejection dimple therein.

16. A propellant filling and sealing valve for conducting a propellant pressurizing fluid or gas into a container through a circular filling hole defined by a rim in a bottom wall of the container and thereafter retaining the propellant under pressure within the container in a non-venting manner, said propellant filling and sealing valve comprising:

an umbrella sealing portion at one end of said valve, said umbrella sealing portion having an arcuate concave bottom surface including an annular sealing surface about the filling hole for making an annular seal at and against the interior surface of the bottom wall, at least the outer periphery of said arcuate concave bottom surface being deformable under pressure to selectively engage, separate from, and then make the annular seal between said annular sealing surface of said arcuate concave bottom surface of said umbrella sealing portion and the interior surface of the bottom wall;

a stem portion integral with said umbrella sealing portion and having a generally cylindrical surface and an arcuate surface, when viewed in cross-section, which merges with said generally cylindrical surface and with said arcuate concave bottom surface of said umbrella sealing portion, and further having at least one filling groove extending axially along and in said stem portion, said generally cylindrical surface of said stem portion being sized to provide snug placement of said valve within said filling hole in the bottom wall; and a collar at the other end of said valve remote from said umbrella sealing portion, said collar being integral with said stem portion and having a generally annular surface or shoulder which extends radially outward from said stem portion beyond the rim of the hole a distance sufficient to prevent said collar from passing inwardly through the filling hole and is adapted to abut against the exterior surface of a portion of the bottom wall of the container about the filling hole, said at least one filling groove extending also through said collar, and said at least one filling groove together with said so-adapted umbrella sealing portion serving to allow pressurizing fluid to enter the container.

17. The valve of claim 16 wherein said annular surface of said collar forming said shoulder portions is generally flat.

18. The valve of claim 16 wherein said stem means has at least two diametrically opposed axially extending filling grooves therein which also extend through said collar.

19. The valve of claim 18 wherein said arcuate concave bottom surface of said umbrella sealing portion has diametrically opposed filling furrows which form a continuation of and extend from said respective filling grooves to said annular sealing surface of said arcuate concave bottom surface of said umbrella sealing portion.

20. A wall assembly for a pressurizable container comprising:

a wall having a circular filling hole defined by a rim therein and having an interior surface adjacent said filling hole, and a propellant filling and sealing valve seated in said hole in a manner which permits a propellant pressurizing fluid or gas to enter a container, when said wall assembly is joined to a container body to form the container, through said filling hole in said wall and which seals and retains the propellant under pressure within the so-formed container, said propellant filling and sealing valve including an umbrella sealing portion located at one end of said valve in the interior of the container, said umbrella sealing portion having an arcuate concave bottom surface including an annular sealing surface adapted to seal against said interior surface of said wall about said filling hole, at least the outer periphery of said arcuate concave bottom surface being deformable when subjected to fluid pressure, to selectively engage, separate from, and then make an annular seal between said annular sealing surface and said wall interior surface, a stem portion integral with said umbrella sealing portion, at least a generally cylindrical portion of which stem portion is positioned within said filling hole, said stem portion having at least one filling groove extending axially along and in said stem portion, and said generally cylindrical portion of said stem portion being sized to provide snug placement of said valve within said filling hole in said wall, and a collar at the other end of said valve remote from said umbrella sealing portion, said collar being integral with said stem portion and having a generally annular surface or shoulder which extends radially outwardly from said stem portion beyond said rim of said hole a distance sufficient to prevent said collar from passing inwardly through said hole and is adapted to abut against the exterior surface of said wall about said filling hole, said at least one filling groove extending also through said collar and said at least one filling groove together with said so-adapted umbrella sealing portion serving to allow pressurizing fluid to enter the container.

21. The wall assembly of claim 16 wherein said wall is a domed bottom wall where the dome extends into the container.

22. The wall assembly of claim 20 combined with a container body, and said wall forming a bottom wall of the container and being seamed or joined to the bottom edge of said container body.

23. The wall assembly of claim 20 wherein said annular surface of said collar forming said shoulder portions is generally flat.

24. The wall assembly of claim 20 wherein said stem means has at least two diametrically opposed axially extending filling grooves therein which also extend through said collar.

25. The wall assembly of claim 24 wherein said arcuate concave bottom surface of said umbrella sealing portion has diametrically opposed filling furrows which form a continuation of and extend from said respective filling grooves to said annular sealing surface of said arcuate concave bottom surface of said umbrella sealing portion.

* * * * *